US007003128B2

(12) United States Patent
Boonen

(10) Patent No.: US 7,003,128 B2
(45) Date of Patent: Feb. 21, 2006

(54) HEARING DEVICE SET FOR TESTING A HEARING DEVICE

(75) Inventor: Maurice Boonen, Winterthur (CH)

(73) Assignee: Phonak AG, Stafa (CH)

( * ) Notice: Subject to any disclaimer, the term of this patent is extended or adjusted under 35 U.S.C. 154(b) by 188 days.

(21) Appl. No.: 10/408,795

(22) Filed: Apr. 7, 2003

(65) Prior Publication Data

US 2004/0196997 A1 Oct. 7, 2004

(51) Int. Cl.
*H04R 25/00* (2006.01)

(52) U.S. Cl. ..... 381/322; 381/60; 381/324

(58) Field of Classification Search ..... 381/60, 381/61, 312, 322, 323, 324, 314; 73/585; 702/103, 104, 116
See application file for complete search history.

(56) References Cited

U.S. PATENT DOCUMENTS 6,603,860 B1 * 8/2003 Taenzer et al. ..... 381/60
6,671,643 B1 * 12/2003 Kachler et al. ..... 702/116
2002/0082794 A1 6/2002 Kachler et al.
2003/0007647 A1 1/2003 Jensen et al.

FOREIGN PATENT DOCUMENTS

WO 97 19573 A 5/1997

OTHER PUBLICATIONS

Patent Abstracts of Japan vol. 2000, No. 19, Jun. 5, 2001 & JP 2001 054198 A (Rion Co Ltd), Feb. 23, 2001.

* cited by examiner

*Primary Examiner*—Huyen Le
(74) *Attorney, Agent, or Firm*—Pearne & Gordon LLP

(57) ABSTRACT

For testing a hearing device a hearing device set is proposed comprising at least one hearing device with at least one acoustical/electrical input converter, at least one electrical/acoustical output converter, at least one communication link tap at the outer surface of said device for wire-bound, optical, wireless or electromagnetic communication to the external, a packaging box for the device specifically conceived for holding the device therein, within said box an acoustical coupler with an acoustical input applicable to said acoustical output of said device and with an acoustical output applicable to the acoustical input of said device.

23 Claims, 2 Drawing Sheets

HEARING DEVICE SET FOR TESTING A HEARING DEVICE

Figure 1:
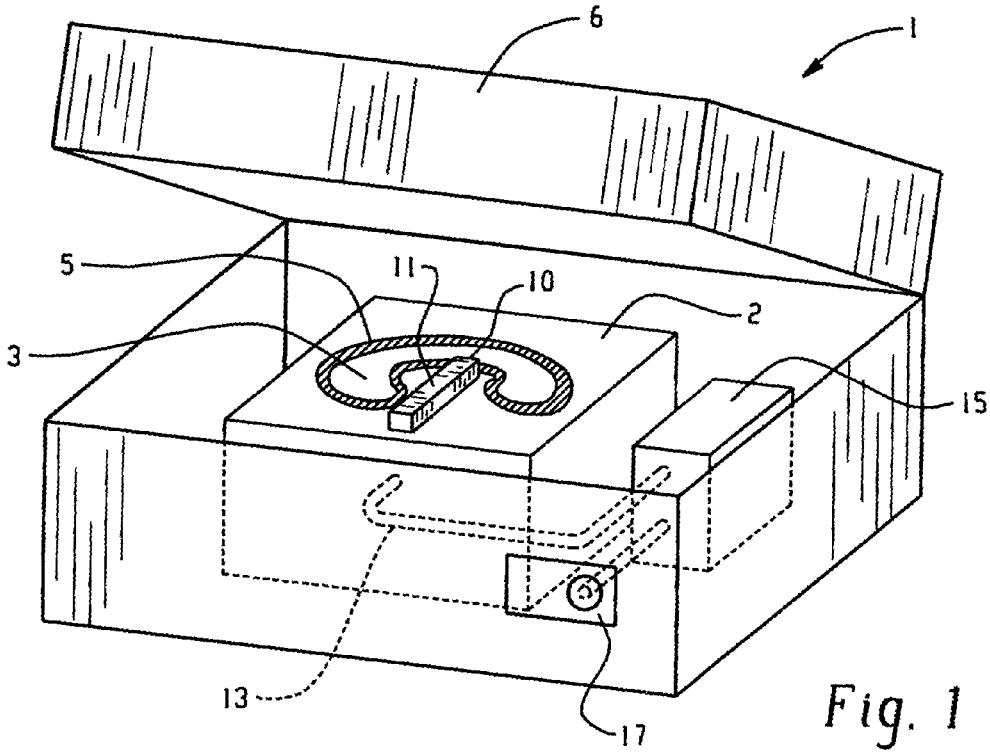

The present invention refers to a hearing device set and to a method for testing a hearing device e.g. with the aid of a hearing device set.

Specifically the present invention refers to a hearing device set for testing hearing devices of the kind having an input acoustical/electrical converter, an output electrical/acoustical converter and a computing unit operationally connecting input to output converter. Such a hearing device may be an in-the-ear device or an outside-the-ear device and thereby a hearing aid device for therapeutical appliances for hearing impaired individuals or may be a consumer hearing device as for headsets, earpieces, earphones, active anti-noise devices, etc.

Whenever proper functioning of such hearing devices is to be tested, customarily the device is installed within a unechoical surrounding and testing is performed making use of an external acoustical/electrical converter as well as of an external electrical/acoustical converter. There is further provided a signal generator and a analysing unit to stimulate on one hand the external acoustical/electrical converter and to analyse on the other hand the result acoustical signal from the external electrical/acoustical converter.

This testing thus necessitates a laboratory-type testing equipment and surrounding. Such testing may only be performed at well equipped locations and by well trained staff From the DE 100 46 098 a method is known for testing the above mentioned hearing devices which is considerably simpler, as concerns testing equipment required, as well as education of testing staff.

Thereby the internal electrical/acoustical output converter of the device is exploited to stimulate the internal acoustical/electrical input converter of the device. The signal transfer path between output of the input converter and input of the output converter is interrupted. A well defined acoustical transmission line is thereby applied between the output of the output converter and the input of the input converter. Very similarly the US 2003/0007647 proposes to apply as such well defined acoustical transmission line a compartment with hard walls, so that the large part of the generated acoustic signal is received by the input transducer.

It is an object of the present invention to further simplify such a testing procedure. This is achieved according to the present invention by a hearing device set according to claim 1.

The inventive hearing device set comprising at least one hearing device with at least one acoustical/electrical input converter, at least one electrical/acoustical output converter, at least one communication link tap at the outer surface of said device for wirebound, optical, wireless or electromagnetic communication to the external.

A packaging box for the device specifically conceived for holding the device therein;

Within said box an acoustical coupler with an acoustical input applicable to said acoustical output of said device and with an acoustical output applicable to the acoustical input of said device.

The acoustical coupler may be a separate part within said packaging box, preferably held within said packaging box. As alternative the acoustical coupler may be formed by an acoustically substantially sealable or closable receiving space within said packaging box for receiving and holding the said hearing device.

According to a possible design the packaging box may comprise a holding member for holding said device in a predetermined position such that acoustical coupler within said packaging acoustically interconnects said acoustical output and said acoustical input of said hearing device, as said hearing device is held in said packaging box. The set further comprises at said packaging box and adjacent said holding member at least one electrical or optical tap connected to said at least one communication link tap of said device, as said device is residing within said holding member and being connected to the at least one electrical or optical tap.

The inventive set may further comprise at least one electrical signal generating device, the signal being representative for an acoustical signal, the signal generating device being in connection with the acoustic output of said hearing device. The set further comprises at least one electric signal receiving unit being in connection with the acoustic input of said hearing device. Further, at least one computing, analyzing and/or testing unit respectively may be arranged for comparing the signal of the electrical signal generating device with the electrical signal, received by the electric signal receiving unit.

According to one possible design of the present invention the electrical signal generating device, the electrical signal receiving unit and possibly the computing, analyzing and/or test device respectively being arranged within said packaging box and being accessible from the surface of said packaging box for operational reason. Further, on the surface of said packaging box a control/monitoring display may be arranged including at least means for indicating, whether the analyzing and/or test device respectively is in operation and whether the result of the analyzing and test procedure is positive or negative.

According to an alternative design of the present invention the electric signal generating device, the electrical signal receiving unit and possibly the computing, analyzing and/or test device respectively or parts thereof being arranged outside of said packaging box and the signal generating device and the signal receiving unit being connectable to corresponding contact portions at the surface of said packaging box, the contact portions being in connection with the electrical or optical tap arranged within said packaging box and being connected to the said at least one communication link tap of said hearing device, the hearing device being arranged within the packaging box. The communication or connection respectively between the contact portions and the electric signal generating device, the electric signal receiving unit and possibly the computing, analyzing and/or test device respectively may be wire-bound, optical, wireless or electromagnetic.

Further, a method for testing a hearing device according to the wording of claim 12 is proposed. Specifically a method for testing a hearing device with an input acoustical/electrical converter with an acoustical input, an output electrical/acoustical converter with an acoustical input is proposed, by placing said hearing device in a packaging box for the device specifically conceived for holding the hearing device therein such that the acoustical output and the acoustical input of said hearing device being acoustically coupled. The method further comprises the steps of generating at least one electric drive signal representing an acoustical signal, driving said output converter of the hearing device with an electrical signal being a function of said drive signal, tapping off an electrical signal dependent from a signal at said output of said input converter of said hearing device and being representative for the received acoustical signal at the acoustical input via the acoustical coupler from said output converter of the hearing device.

Further, said tapped off electrical signal and the said electric drive signal are compared within a computing, analyzing and/or testing unit for testing the performance of the hearing device.

According to one aspect of the invention it may be intended that a testing procedure is effected automatically each time the hearing aid device is placed within the packaging box and the box is closed.

According to a further aspect it may be planned that the testing procedure is effected in a certain rhythm, like e.g. each month, in which case of course a timer unit has to be combined with the inventive device set.

According to a further aspect the testing procedure may be effected after a certain predetermined amount of opening or closing procedures, as users of the hearing aid device usually remove the device in the morning and place the device back into the box in the evening, so that the testing procedure may be repeated after 30, 60, 120, etc. of mentioned removing and placing back procedures.

Figure 2:
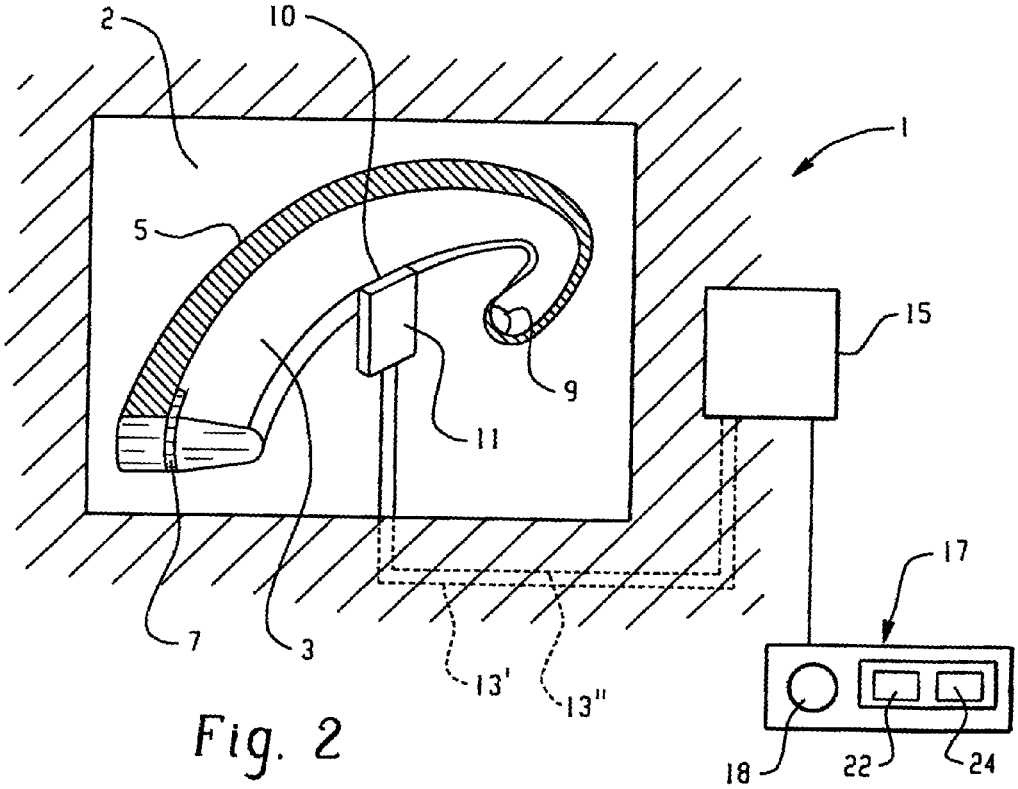
Figure 3:
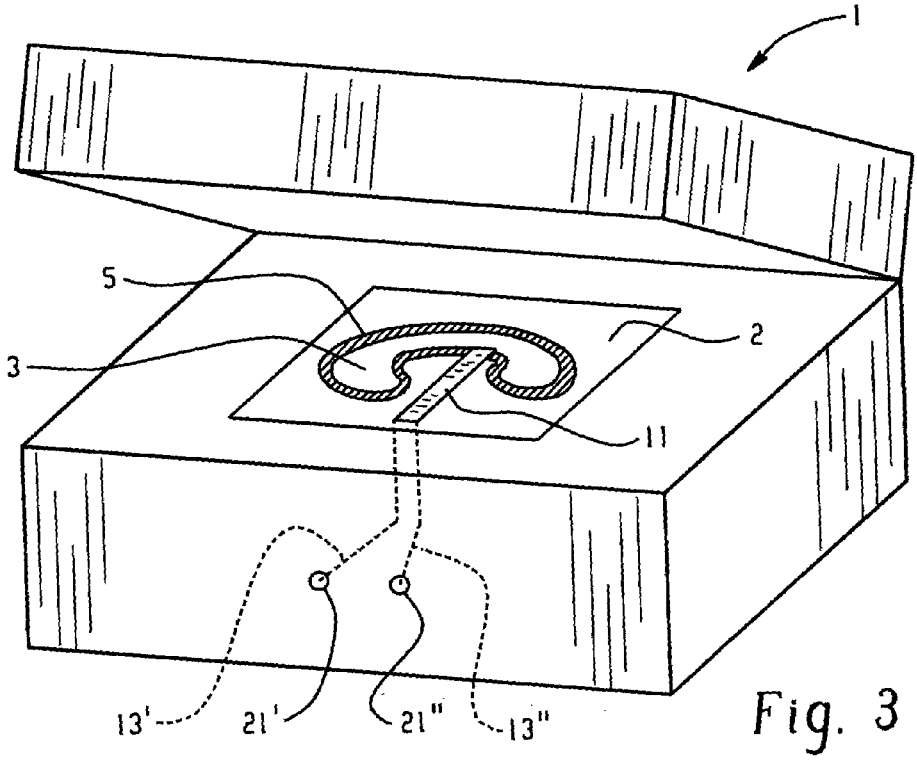
Figure 4:
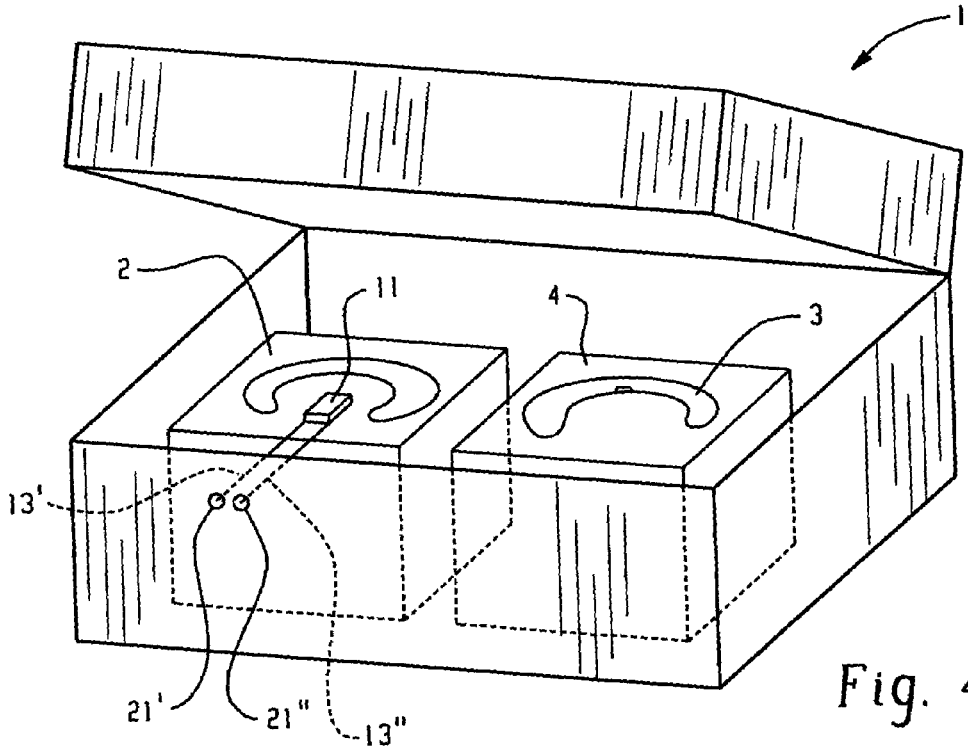

The present invention shall now be described more in details and by way of examples with the help of figures. These figures show:

FIG. 1 schematically, in perspective an opened packaging box including a hearing aid device and a testing arrangement for testing the device;

FIG. 2 in details, the receiving hollow space of the packaging box of FIG. 1 with the hearing aid device and the arrangement for testing the device;

FIG. 3 schematically and in perspective, a further design of a packaging box including a hearing aid device for a testing purpose and connections to corresponding connection areas in one side wall of the packaging box for being connected to an outside arranged testing arrangement for testing the hearing aid device, and FIG. 4 a further embodiment of a packaging box schematically and shown in perspective, again including a hearing aid device placed in a separate receptacle space and including a testing space for a hearing aid device to be tested and connections for the hearing aid device to be connected to a testing arrangement.

FIG. 1 shows schematically and in perspective an opened packaging box 1, in which box a hollow space 2 is arranged for receiving a hearing aid device 3. The packaging 1 may be a conventional box for storing and transporting the hearing aid device 3.

According to the invention it is proposed that the e.g. conventional storing and transporting box 1 is including additionally a testing arrangement, for the testing purpose of the hearing aid device 3. This testing arrangement or set respectively may comprise an acoustic coupler 5, which is arranged adjacent to the hearing aid device 3 for acoustically coupling an acoustic output of the hearing aid device with an acoustical input such as e.g. a microphone of the hearing aid device 3. This coupler may be a tube-like or pipe-like device with open ends directed to the acoustical output of the hearing aid device and to the acoustical input.

Furthermore, at the outside surface of the hearing aid device at least one communication link tap 10 is provided for communication to the external of a signal computing unit enclosed within the hearing aid device, which computing unit is arranged between the acoustical/electrical input converter and the electrical/acoustical output converter of the hearing aid device. This communication to the external via the communication link tap 10 may be a wirebound, an optical, a wireless or electromagnetic communication.

The communication link tap might be connected to a connector device 11, which is such arranged that the hearing aid device placed within the receiving space 2 of the packaging box is preferably automatically connected with the communication link tap 10 to the connector device 11. The connector device 11 itself is interconnected with an acoustical/electrical testing arrangement 15, which is described later on in details. For operational reasons such as controlling and monitoring the testing arrangement 15 is connected to a display arrangement 17, provided in one side wall of the packaging box 1.

In FIG. 2 the hearing aid device and the testing arrangement are shown in more details in a schematic way. Again within the receptacle hollow space 2 the hearing aid device 3 is arranged together with the acoustical coupler device 5 for interconnecting the acoustical output 9 of the hearing aid device 3 with an acoustical input such as e.g. a microphone 7 of the hearing aid device 3. As schematically shown this acoustical coupler device 5 may be a pipe-like or tube-like device. Of course instead of the schematically shown tube-like device 5 any different kind of acoustical coupler device might be used, or as an alternative the hollow space 2 could be designed such that in a closed status of the packaging box 1 the hollow space 2 is an in itself completely acoustically sealed or closed space, which is insulated against any noise from the surroundings. In such a case the hollow space 2 itself is the acoustical coupler, and there is no need for additionally placing a tube-like device, as shown in FIG. 2.

A signal computing unit, arranged within the hearing aid device 3 for interconnecting the microphone 7 with the acoustical output 9 is connected to the communication link tap 10 for communication to the external, which means for being connected to a connecting device 11, which in turn is in connection to the communication link tap 10. The connector device 11 itself is connected to the testing arrangement 15 e.g. via at least two wire connections 13' and 13", which testing arrangement 15 again is connected to the outside surface of the packaging box with a corresponding operation/controlling and/or monitoring display 17.

With the aid of the schematically shown view of the arrangement in FIG. 2 the operation of the invention shall be described in details.

If the operation of a hearing aid device 3 has to be tested, the device 3 may be placed within a hollow receptacle space 2 of a packaging box 1, which might be the original packaging box of the hearing aid device for storing and transporting the hearing aid device. Or the box 1 can be a specifically used box for testing purpose. Especially in case that no specific acoustic coupler device 5 is arranged within the hollow space 2 the cover 6 of the packaging box has to be closed. In case of an acoustic coupler device 5 the cover 6 may be opened.

The testing operation shall be initiated by e.g. manually starting the operation by pushing a corresponding button 18 on the display 17. Within the testing arrangement 15 an electrical signal generating device shall generate an electrical signal, which is representative for an acoustical signal, This electrical signal shall be transported via a wire connection 13' to the connector 11 and from there via the communication link tap 10 to the signal computing unit within the hearing aid device 3, so that a corresponding acoustical signal is initiated and produced at the acoustical output 9 of the hearing aid device. The acoustical signal shall be transported via the acoustical coupler device 5 or through the hollow space 2 to the microphone 7 of the hearing aid device 3, where it is received and again converted to an electrical signal. This electrical signal again is transferred via the communication link tap 10, the connector device 11 and the wire 13" to the testing arrangement 15, where it is transferred to an electrical signal receiving unit within the arrangement 15. In a final step the initially generated electrical signal, generated by the electrical signal generating device and the received electrical signal, received by the electrical signal receiving unit, shall be compared and analyzed in a respective analyzing unit. According to the analyses it can be judged, whether the hearing aid device is well functioning or whether the hearing aid device does have a defect.

The result of the testing procedure may be displayed on the monitoring display 17, where e.g. a green and a red Liquid Crystal Display may be arranged. If the hearing aid device operates perfectly, the green light 22 is illuminated, if the result is negative, the red light 24 is illuminated.

In case that the testing procedure has to be executed according to a predetermined rhythm, like e.g. after certain time periods or after certain cycles of use, the testing and analyzing set has to be connected to a timer or counter unit, which initiates a testing and analyzing procedure after certain time periods, such as e.g. each month, or after certain cycles of use, which means e.g. after 100, 200, etc. opening and closing procedures of the packaging box.

The function of the electrical signal generating device, the electrical signal receiving unit and the analyzing unit shall not be described in details, as this is well-known out of the state of the art. References to test controlling devices for hearing aid devices are indicated e.g. within the description.

In FIG. 3 a further embodiment of the invention is shown, again in perspective view.

Again within a packaging box 1 a hollow space 2 is arranged specifically conceived for holding a hearing aid device 3 therein. Again adjacent to the hearing aid device 3 an acoustic coupler 5 may be arranged for interconnecting an acoustical output with an acoustical input of the hearing aid device 3. Again equivalent to the design of FIGS. 1 and 2 a communication link tap 10 is connected to a connector device 11, which in contradiction to the design of FIGS. 1 and 2 is connected via wires 13' and 13" to respective connecting areas 21 and 21', arranged within one side wall of the packaging box 1. By using the embodiment of FIG. 3 it is possible to connect an outside testing and analyzing unit to the packaging box 1 for function control and testing purpose of a hearing aid device 3, which is arranged within the hollow space 2. The advantage of the embodiment according to FIG. 3 is that the relatively expensive analyzing and testing unit can be used for testing various hearing aid devices 3, arranged or stored within individual packaging and transporting boxes 1. In addition it is possible to connect different kinds of testing and analyzing units, which might be feasible for testing various functional parameters within the hearing aid device or the signal computing unit within the hearing aid device.

FIG. 4 again shows a further different embodiment of the invention in perspective view. Besides the hollow space 2 for receiving a hearing aid device for testing purpose, the box shown in FIG. 4 does include a further receptacle space 4 with the only purpose of storing a hearing aid device 3. The design of the hollow space 2 with the acoustical coupler, the connector device 11, etc. is equivalent to the design shown and described in FIG. 3. Again an exterior testing and analyzing unit may be connected via connecting areas 21' and 21" to the hearing aid device to be tested within the hollow space 2.

The advantage of the embodiment according to FIG. 4 is that not every time the hearing aid device has to be stored within the testing hollow space 2, as placing and storing the hearing aid device 3 within the testing hollow space 2 is far more sensitive than storing the device within the storing and transporting space 4. In other words the holding mechanism, the connecting between the communication link tap and the connector device 11 only shall be used when necessary and not also in case that the device only shall be stored and not be tested.

The various embodiments shown in FIGS. 1 to 4 are only examples for the purpose of describing the present invention in more details. Of course the invention is not at all limited to the embodiments shown in FIGS. 1 to 4, and variations, different designs, different testing arrangements, etc. are also falling under the scope of the present invention as long as the basic idea is similar or the same. The big advantage of the present invention is that for testing purpose a hearing aid device does not have to be stored within a specific testing arrangement or testing device, but the testing can be done anytime directly with the aid of the storing and transporting box, which is used for storing and/or transporting the hearing aid device. In addition not a specific acoustically insulated arrangement has to be used, as e.g. by closing the cover of the storage box the hollow space including the hearing aid device is preferably acoustically insulated against noise of the surroundings and testing can be performed.

What is claimed is:

1. A hearing device set comprising at least one hearing device with at least one acoustical/electrical input converter, at least one electrical/acoustical output converter, at least one communication link tap at an outer surface of said hearing device for wire-bound, optical, wireless or electromagnetic communication to an external of a computing unit, a packaging box for the hearing device adapted for holding the hearing device therein, within said box an acoustical coupler with an acoustical input applicable to an acoustical output of said hearing device and with an acoustical output applicable to an acoustical input of said hearing device.

2. The set of claim 1, wherein said coupler within said packaging box is a separate part held within said packaging box.

3. The set of claim 1, wherein said coupler is formed by an acoustically substantially sealable or closable receiving space within said packaging box for receiving and holding said hearing device.

4. The set of claim 1, wherein said packaging box comprises a holding member for holding said hearing device in a predetermined position so that said acoustical coupler within said packaging box acoustically interconnects said acoustical output and said acoustical input of said hearing device as said hearing device is held in said packaging box.

5. The set of claim 4, further comprising adjacent said holding member at least one electrical or optical tap connected to said at least one communication link tap of said hearing device wherein said hearing device is residing within said holding member and being connected to the at least one electrical or optical tap.

6. The set of claim 4 further comprising at least one electrical or optical tap operatively connected to said at least one communication link tap;

wherein said at least one electrical or optical tap is adjacent to said holding member and wherein hearing device resides within said holding member and is operatively connected to said at least one electrical or optical tap.

7. The hearing device set of any of the preceding claims 1 to 5, further comprising at least one electric signal generating device generating a signal representative of an acoustic signal, the signal generating device to the acoustic output of the hearing device, and at least one electric signal receiving unit to the acoustic input of the hearing device.

8. The set of claim 7, further comprising at least one computing, analyzing and/or test unit respectively for comparing the signal of the electrical signal generating device with a signal received from the electric signal receiving unit.

9. The set of claim 8, wherein the electric signal generating device, the electrical signal receiving unit and the analyzing and/or test device being arranged outside of said packaging box and the signal generating device and the signal receiving unit being connectable to corresponding contact portions at a surface of said packaging box, the contact portions being in connection with the electrical or optical tap arranged within said packaging box.

10. The set of claim 8 further comprising connecting areas positioned on an outside wall of said packaging box;

wherein and said electrical or optical tap are arranged within said packaging box, wherein said electric signal generating device, said electrical signal receiving unit and said analyzing and/or test device are arranged outside of said packaging box, wherein said connecting areas operatively connect said electrical or optical tap to electric signal generating device, said electrical signal receiving unit and said analyzing and/or test device.

11. The set of claim 7, wherein the electric signal generating device and the electric signal receiving being arranged within said packaging box and being accessible from a surface of said packaging box for operational reason.

12. The set of claim 7, wherein the signal generated by the signal generating device represents an acoustical signal.

13. The set of claim 7, wherein the electric signal generating device and the electric signal receiving unit are arranged within said packaging box and are operable from an outside surface of said packaging box.

14. The set of claim 1, wherein the packaging box comprising a further receiving space for an arrangement of the hearing aid device when not being tested.

15. The set of claim 1 further comprising a receptacle space for storing the hearing aid device when the hearing aid device is not in use.

16. Method for testing a hearing device with an input acoustical/electrical converter with an acoustical input, an output electrical/acoustical converter with an acoustical output, a computing unit with an input operationally connected to an output of said acoustical/electrical converter and with an output operationally connected to an input of said electrical/acoustical converter, comprising the steps of placing said hearing device in a packaging or storing box for the hearing device adapted for holding the hearing device therein, such that the acoustical output and the acoustical input of said hearing aid device being acoustically coupled;

generating at least one initial electric drive signal representing an acoustical signal;

driving said output converter for producing a corresponding acoustical signal being a function of said initial electric drive signal;

tapping off a received electrical signal dependent from a signal at said output of said input converter, the input converter having received an acoustical input signal via the acoustical coupler from the acoustical output of said output converter; and determining from said received signal tapped off characteristic of signal transfer between said output converter and said input converter of said hearing aid device.

17. Method according to claim 16, wherein the at least one initial electric drive signal and the received electrical signal tapped off at said output of said input converter are compared within an analyzing unit for determining well-function or malfunction of the hearing device.

18. Method according to claim 16 or 17, wherein testing of the hearing device is effected automatically after a certain time period or after a certain cycle of use.

19. Method according to claim 16 or 17 further providing a timer, wherein the timer measures a predetermined time period to automatically test the hearing device.

20. Method according to claim 16 or 17 further providing a counter, wherein the counter measures the number of cycles the packaging box is opened and closed and automatically tests the hearing device after a predetermined number of cycles.

21. Method according to claim 16 or 17 further providing a counter, wherein the counter measures the number of cycles the hearing device is removed from and returned to the packaging box and automatically tests the hearing device after a predetermined number of cycles.

22. The set of claim 1, wherein the coupler is removably held within said pacakging box.

23. The set of claim 1, wherein said coupler is formed by a substantially acoustical sealable or closed space within said packaging box.

* * * * *

UNITED STATES PATENT AND TRADEMARK OFFICE

CERTIFICATE OF CORRECTION

PATENT NO. : 7,003,128 B2
APPLICATION NO. : 10/408795
DATED : February 21, 2006
INVENTOR(S) : Maurice Boonen It is certified that error appears in the above-identified patent and that said Letters Patent is hereby corrected as shown below:

Column 2, line 53: Please delete "12", and insert therefor --16--.

Signed and Sealed this

Twenty-first Day of November, 2006

JON W. DUDAS
*Director of the United States Patent and Trademark Office*